US008893532B2

(12) United States Patent
Geyer et al.

(10) Patent No.: US 8,893,532 B2
(45) Date of Patent: Nov. 25, 2014

(54) DRUM FOR A LAUNDRY TREATMENT MACHINE

(75) Inventors: Johannes Geyer, Haar (DE); Stephan Sommer, Falkensee (DE); Wilfried Wildung, Berlin (DE)

(73) Assignee: BSH Bosch und Siemens Hausgeraete, Munich (DE)

( * ) Notice: Subject to any disclaimer, the term of this patent is extended or adjusted under 35 U.S.C. 154(b) by 1004 days.

(21) Appl. No.: 12/865,882

(22) PCT Filed: Feb. 11, 2009

(86) PCT No.: PCT/EP2009/051550
§ 371 (c)(1),
(2), (4) Date: Aug. 3, 2010

(87) PCT Pub. No.: WO2009/101098
PCT Pub. Date: Aug. 20, 2009

(65) Prior Publication Data

US 2010/0326142 A1 Dec. 30, 2010

(30) Foreign Application Priority Data

Feb. 14, 2008 (DE) ..... 10 2008 009 141

(51) Int. Cl.
*D06F 37/04* (2006.01)
*D06F 37/06* (2006.01)

(52) U.S. Cl.
CPC ..... *D06F 37/06* (2013.01); *D06F 37/04* (2013.01)
USPC ..... 68/142; 68/139; 68/144

(58) Field of Classification Search
USPC ..... 68/142
See application file for complete search history.

(56) References Cited

U.S. PATENT DOCUMENTS

| | | | | |
|---|---|---|---|---|
| 2003/0167804 | A1 | 9/2003 | Yoon | |
| 2004/0123634 | A1 | 7/2004 | Kim et al. | |
| 2005/0103060 | A1* | 5/2005 | Ozturk et al. | 68/3 R |
| 2007/0295035 | A1* | 12/2007 | Lim | 68/3 R |
| 2008/0229516 | A1 | 9/2008 | Hashimoto | |

FOREIGN PATENT DOCUMENTS

| | | | |
|---|---|---|---|
| DE | 1805126 | U | 2/1960 |
| DE | 1290909 | | 3/1969 |
| DE | 4437986 | A1 | 4/1996 |
| DE | 19952990 | | 5/2001 |
| DE | 10-2006-041431 | A1 | 6/2007 |
| EP | 1028189 | | 8/2001 |

* cited by examiner

*Primary Examiner* — Joseph L Perrin
*Assistant Examiner* — Levon J Shahinian
(74) *Attorney, Agent, or Firm* — Nixon & Vanderhye, P.C.

(57) ABSTRACT

A laundry drum for a laundry treatment machine that is rotatable about an axis, wherein the laundry drum includes a drum jacket made of metal sheet, and wherein the drum jacket has throughflow holes and linear elevations that are distributed in a peripheral direction and that extend transversely to a periphery line. The linear elevations rise at a distance from one another in a straight or curved line from cylindrical regions of the laundry drum. Agitators are disposed on an inner periphery of the drum jacket and the throughflow holes are disposed in the cylindrical regions.

28 Claims, 6 Drawing Sheets

DRUM FOR A LAUNDRY TREATMENT MACHINE

BACKGROUND OF THE INVENTION

The invention relates to a laundry drum for a laundry treatment machine that can be moved in a rotating manner about an axis, having a drum jacket provided with throughflow holes, said drum having linear elevations that are distributed in the peripheral direction and extend at right angles to the periphery, said elevations rising from the peripheral surface of the drum jacket provided in the drum.

Such a laundry drum is known from DE 10 2006 041 431 A1. Here the allegedly excessive mechanical action of the known agitators on the laundry is criticized. It is therefore proposed to dispense with such agitators completely and instead distribute linear elevations that extend at right angles to the periphery and from the facing wall to the rear wall of the drum in the peripheral direction of the drum jacket, said elevations consisting of concave and convex curves in relation to the drum axis and running into one another in the manner of a wave. Apart from the fact that appropriately embodied known agitators do not represent any risk to the laundry, their mechanical treatment action cannot be replaced by linear elevations with shallow undulations. Also the wave-type curves running into one another require the provision of throughflow holes in both the wave troughs and on the wave tips. Both types of hole provision, but in particular the last-mentioned, represent a risk to the laundry, when items of laundry are forced through the throughflow holes when subject to significant spin forces.

Another type of washing drum is known from DE 44 37 986 A1. Here structures are primarily shown in the metal sheet of the jacket of a laundry drum in the form of mutually offset square or hexagonal arched surfaces. Such structures are predominantly used with laundry drums because on the one hand they give the structured metal sheet of the jacket a certain stability of form, which primarily manifests itself in a reduced tendency to acoustic oscillation. On the other hand however such a structure also has a certain decorative effect. It has not however been possible to prove the once assumed advantageous influence on the mechanical treatment of the laundry.

A laundry drum is also known from DE 1 805 126 U, in which the jacket of a laundry drum made of thermoplastic plastic has a plurality of small, angular ribs which, in addition to their—decidedly non-critical—mechanical action on the passing laundry primarily have a stabilizing effect on the connection between the drum jacket and the adjoining base parts of the drum. Since the drum jacket does not have throughflow holes, the exchange of washing liquor between the inner chamber and outer chamber is very limited.

BRIEF SUMMARY OF THE INVENTION

The object of the invention is to find a metal sheet jacket structure for a laundry drum as described in the introduction, which on the one hand has the advantageous characteristics of structures of the prior art but also creates the basis for their configuration to influence the mechanical laundry treatment advantageously during the rotational movement of the drum.

According to the invention this object is achieved in that the linear elevations rise at a distance from one another in a straight line or curved from cylindrical regions of the laundry drum and are also disposed on agitators that are known per se on the inner periphery of the drum jacket and in that the throughflow holes are disposed in the cylindrical regions.

Such elevations can—as described again below—be configured in such a diverse manner that they have an advantageous influence on mechanical laundry treatment during drum rotation. As they also stabilize the drum jacket to the extent that the material outlay for the metal sheet of the drum can be reduced to a minimum, there is no fear of a tendency to acoustic oscillation and the surface characteristics of a jacket surface thus formed are precisely ideal for laundry treatment, an inventively configured laundry drum is the optimum for use in laundry treatment.

The elevations can therefore follow straight lines, which extend at least partially parallel or not parallel to one another and/or to the direction of the axis of the drum. The linear elevations can be at identical or different distances from one another and have identical or at least partially non-identical or different widths. They can follow wave-type lines, e.g. sine waves, zigzag lines or helical lines and can be offset with identical phases in relation to one another or counter to one another when viewed in relation to the peripheral direction of the drum. In the case of a laundry drum with throughflow holes in the drum jacket at least some of the throughflow holes can be positioned in respectively one or both sides of the elevations. Other throughflow holes are positioned in the areas of the drum jacket away from the elevations.

BRIEF DESCRIPTION OF THE DRAWING

The invention is described in more detail below with reference to exemplary embodiments illustrated in the drawing, in which.

DETAILED DESCRIPTION OF EXEMPLARY EMBODIMENT OF THE PRESENT INVENTION

Figure 1:
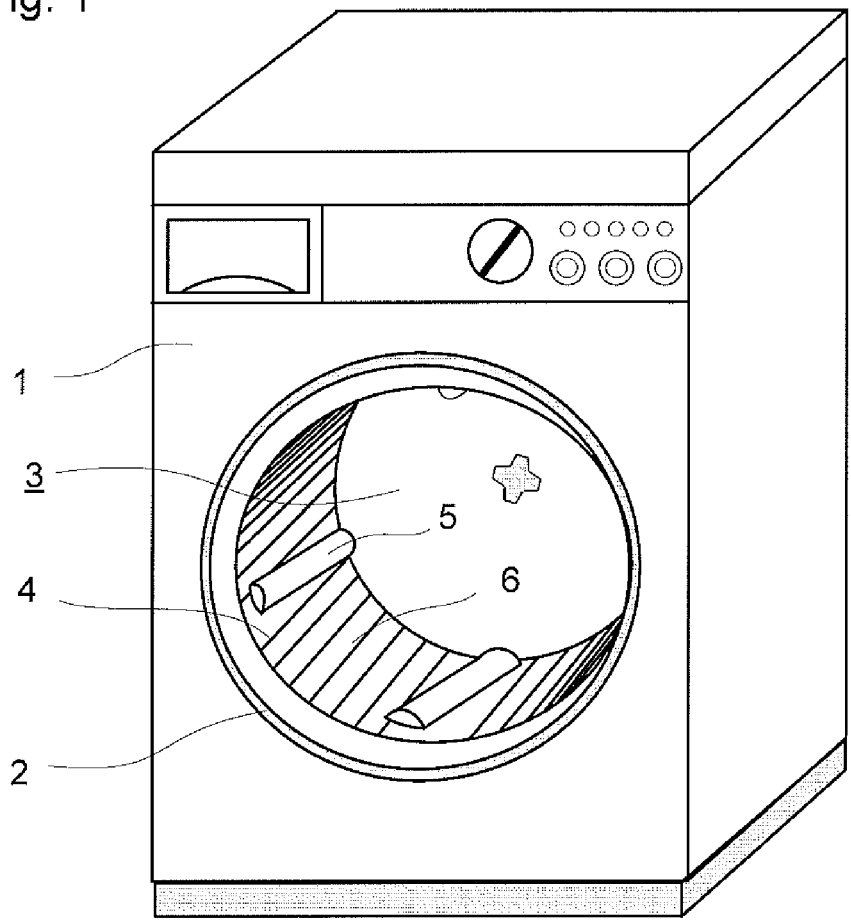
FIG. 1 shows a perspective view of the front face of a laundry treatment machine, with a free view into the laundry drum, the metal sheet of the jacket of which is provided with linear elevations on the inside.

FIG. 1 shows a laundry treatment machine in the form of a washing machine, the loading opening 2 of which is disposed on the front face 1 and allows a view into the interior of the laundry drum 3 when the door is removed. It has a cylindrical drum jacket 4, on the inside of which a number of laundry agitators are regularly distributed. The drum jacket 4 also has linear elevations 6 that curve inward and are described in more detail with reference to the figures that follow. These elevations on the one hand ensure that the drum jacket has a structure that is resistant to mechanical oscillations and as a result there is none of the acoustic interference that is otherwise to be feared. On the other hand the considerable gain in rigidity means material savings with the smaller wall thicknesses of the drum jacket 4 and—as will be illustrated in the following—a surface configuration that is particularly kind to laundry but nevertheless has an enhanced mechanical washing action.

Figure 2:
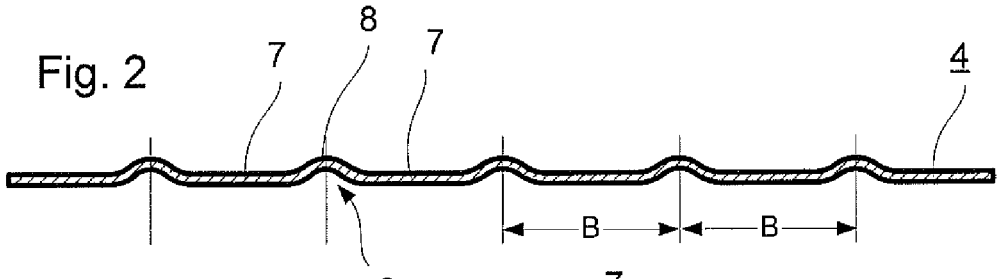
FIG. 2 shows a cross section through a part of an unrolled metal sheet jacket parallel to the peripheral direction of the laundry drum with linear elevations.
Figure 3:
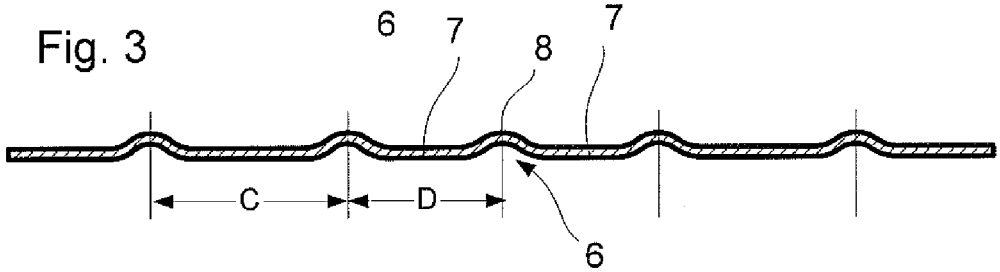
FIG. 3 shows a cross section as in FIG. 2 with different distances between the linear elevations.

For example linear elevations 6 according to FIG. 1 can have a form as shown in FIG. 2 or 3 when viewed in the cross section of the metal sheet of such a drum jacket 4. The elevation 6 then oscillates gradually out of the cylinder form of the region 7 of the drum jacket 4 inward, forms a smooth ridge line 8 and oscillates equally smoothly back into the cylinder form of the region 7. The regions 7 remaining in the cylinder form may remain closed—as shown—in a laundry treatment machine that does not require an exchange of fluid for the treatment process. The cross sections shown in FIGS. 2 and 3 are parts of the unrolled drum jacket 4 shown extended, which would have to be shown curved downward as part of the rolled drum jacket 4, so that the regions 7 pointing upward (in the direction of the elevations 6) would form a concave surface.

In a laundry treatment machine that exchanges fluids between the laundry, the drum interior and the space surrounding the laundry drum—e.g. in a washing machine—what are known as throughflow holes have to be provided in the cylindrical regions. Such throughflow holes are known but are not shown in FIGS. 1 to 3 for reasons of simplification.

The distances B between the elevations 6 in FIG. 2 are of identical length, in contrast to the elevations 6 in FIG. 3, where the distances C and D are different. This can play a role in treatment processes, in which the laundry is distributed irregularly within the drum during its rotation.

The fragments of drum jackets 4 are also shown in the figures that follow as essentially level flat bodies that can be shaped into a laundry drum by forming into a cylinder. Unlike the examples in FIGS. 2 and 3 the elevations 6 also do not oscillate gradually from the cylindrical regions inward, as they adjoin the regions 7 by means of a relative sharp bending edge 9. The elevations 6 or their arrangement in relation to one another differ(s) on the one hand from those in FIGS. 2 and 3 and on the other hand also from exemplary embodiment to exemplary embodiment.

Figure 4:
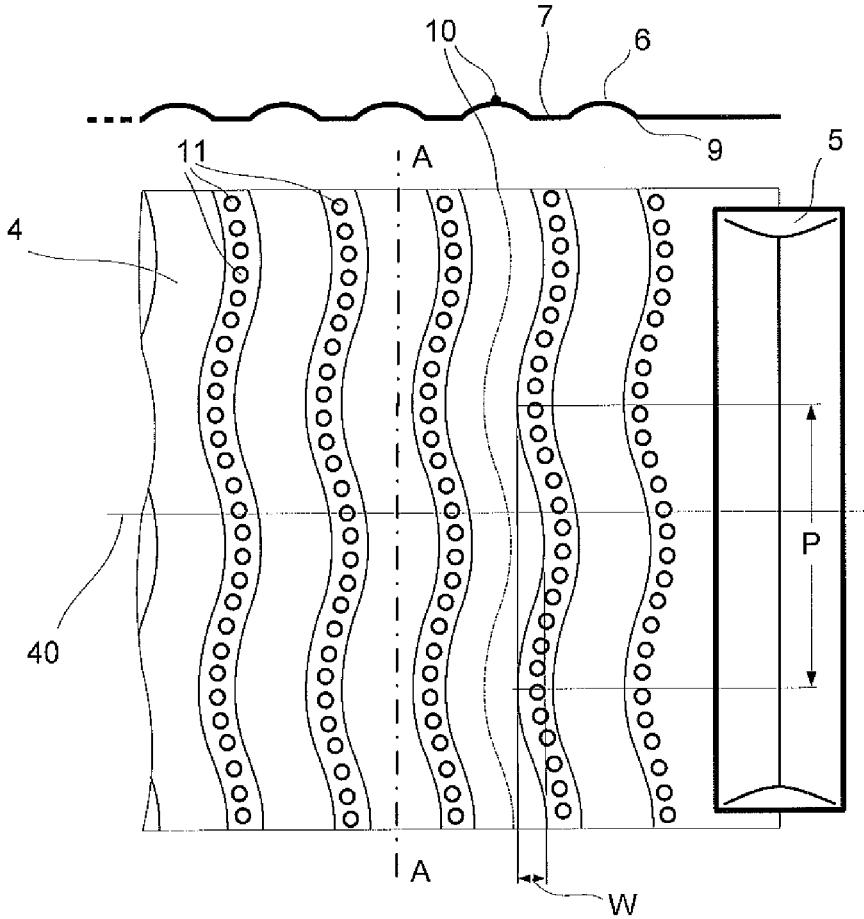
FIG. 4 shows the view from outside onto a metal sheet jacket with wave-type elevations with identical phases and a cross section through such a metal sheet jacket parallel to the peripheral direction of the laundry drum.

FIG. 4 therefore shows a drum jacket 4, on the inside of which linear elevations 6 arch, which lie at right angles to the periphery 40 and essentially parallel to the drum axis A-A. The ridge lines 10 of the elevations here follow an oscillation in the manner of a sinusoidal form with a phase length P and an oscillation width W. The phase length P and oscillation width W can be varied as required and by experiment taking into account the mechanical washing action. They can also be shorter or longer at the edges than in the center of the drum jacket 4. The cylindrical regions 7 of the drum jacket between the elevations 6 each contain a series of throughflow holes 11.

Figure 5:
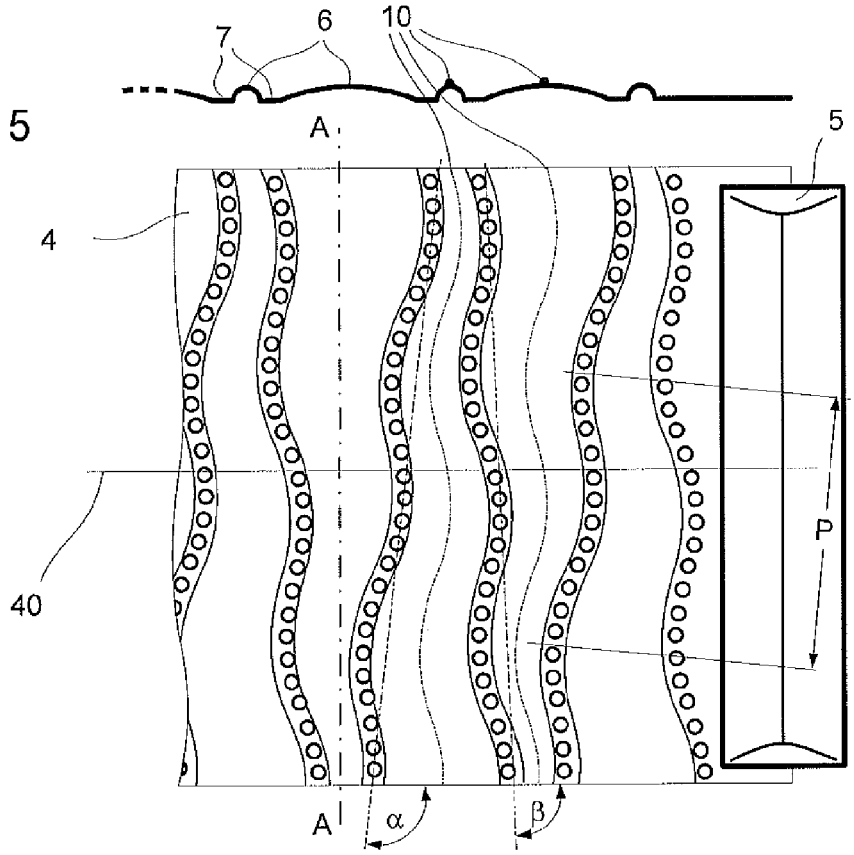
FIG. 5 shows an outer view and cross section according to FIG. 4 with non-parallel wave-type elevations of differing widths.

The drum jacket 4 shown in FIG. 5 also has linear elevations 6. However adjacent regions 7 between the elevations do not run parallel to one another. Their principal axes are at an angle $\alpha \approx 100°$ or $\beta \approx 80°$ to the periphery 40, which therefore deviates from a right angle. The phase length P and oscillation width W in this example are similar to those in FIG. 4. Before the regions 7 touch each other, they can reverse their angular position $\alpha$ or $\beta$ and therefore the elevations 6 having the greatest width and height at the point of the greatest proximity of adjacent regions 7 narrow again as they continue. Instead however the length of the elevations 6 could simply be limited, so that the regions 7 between the limits could be contiguous. The angular positions of the principal axes of the regions 7 can be varied as required and by experiment—as of course can the phase lengths and oscillation widths as well.

Figure 6:
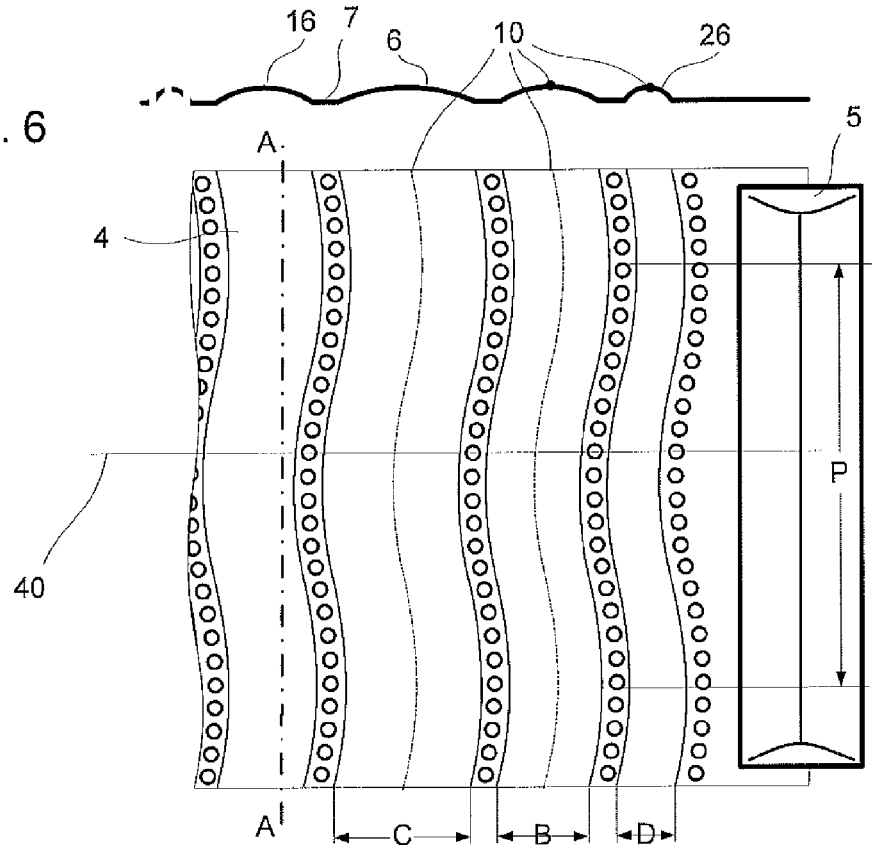
FIG. 6 shows an outer view and cross section according to FIG. 4 with parallel wave-type elevations with identical phases but differing widths.

The drum jacket 4 in FIG. 6 is very similar to the one in FIG. 4. Here the phase lengths of the elevations 6, 16 and 26 are greater than in FIG. 4. Also the parallel regions 7 are at different distances B, C and D from one another, so that the elevations 6, 16 and 26 in between are of differing widths. The elevations 6, 16 and 26 have almost the same heights as one another, so the elevation 6 is felt to be flatter than the elevations 16 and 26 but it is just that the curvature of its arch is smaller. The same variations as in the previous and following examples are possible here too. These also include variations in the heights of the elevations 6 or 16 and 26.

Figure 7:
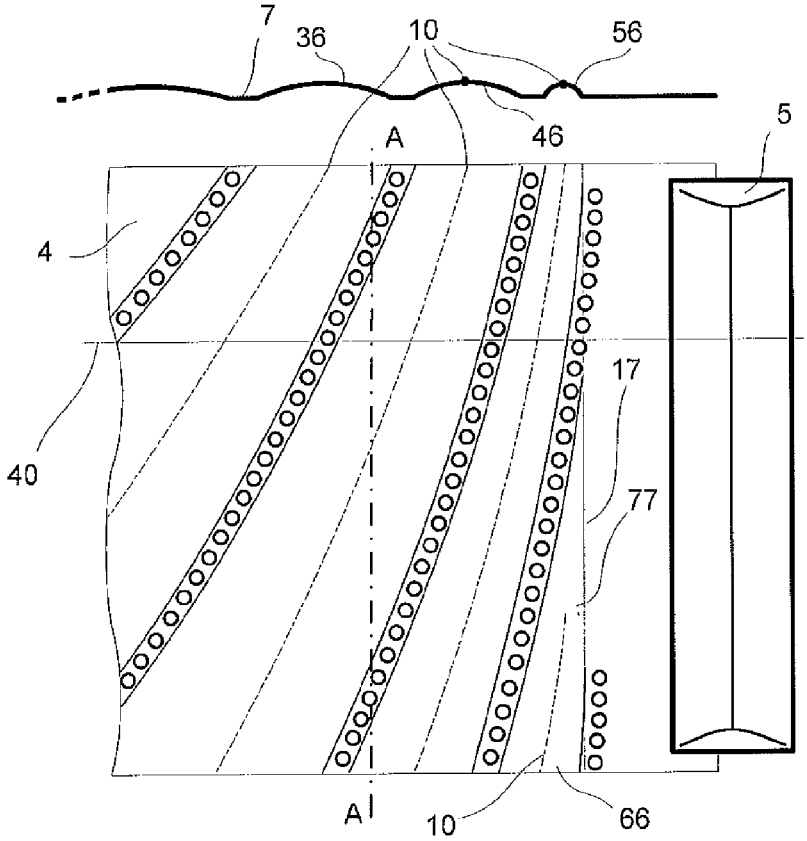
FIG. 7 shows an outer view and cross section according to FIG. 4 with curved elevations disposed helically and having differing widths.

In contrast the elevations 36, 46 and 56 in FIG. 7 follow a quite different regularity. As can be seen in the region 77 an elevation 66 rises gradually from the peripheral line 17 adjacent to an agitator 5 and its ridge line 10 follows a helical line. In this manner the ridge lines of all the elevations 36, 46, 56 and 66 diverge increasingly and the elevations 36, 46, 56 and 66 widen until they meet steeply and end at the other peripheral line in front of the adjacent agitator 5. This exemplary embodiment may be of interest primarily in laundry treatment machines where movement of the laundry along the axis of rotation of the laundry drum 4 is to be promoted by controlling the drum rotation direction.

Figure 8:
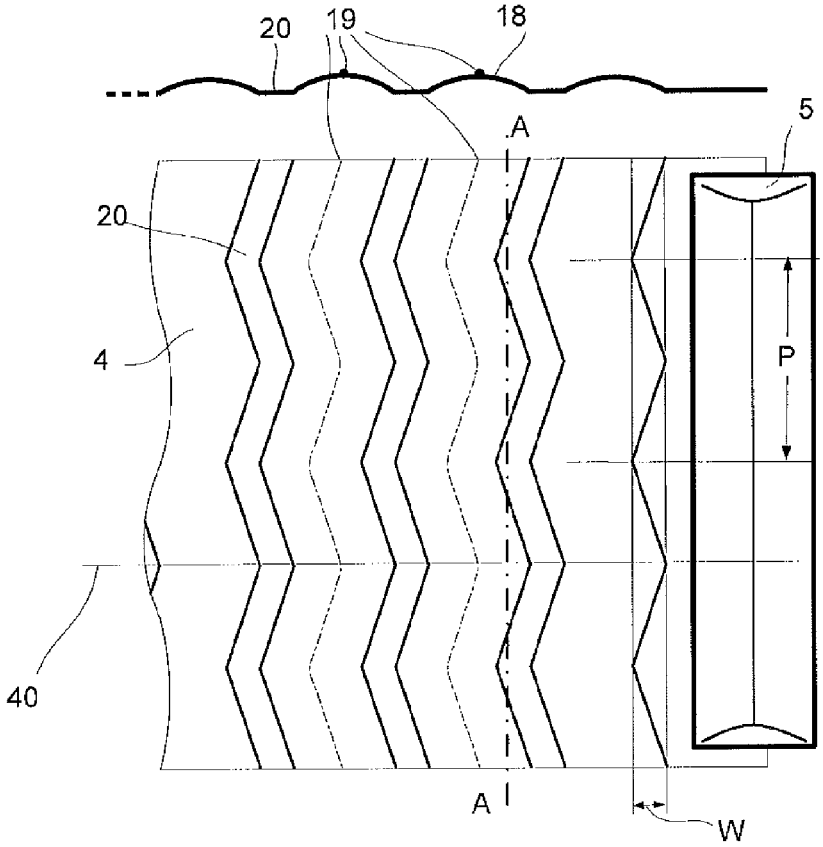
FIG. 8 shows an outer view and cross section according to FIG. 4 with elevations in zigzag lines, with identical phases and disposed in a parallel manner with identical widths.

In one exemplary embodiment in FIG. 8 the elevations 18 have roughly the same length phases P as the sinusoidal elevations 6 in FIG. 4. The oscillation width W is somewhat greater. This type of elevation 18 is an elevation 18 bounded by zigzag-type cylindrical regions 20 of the drum jacket 4, the ridge lines 19 of which also follow a zigzag line at least approximately. However the sharp corners of this zigzag line are rounded. No throughflow holes are shown in the cylindrical regions 20 here. However throughflow holes are to be provided in these regions 20 when a fluid that moves between the interior and exterior of the drum is used.

Figure 9:
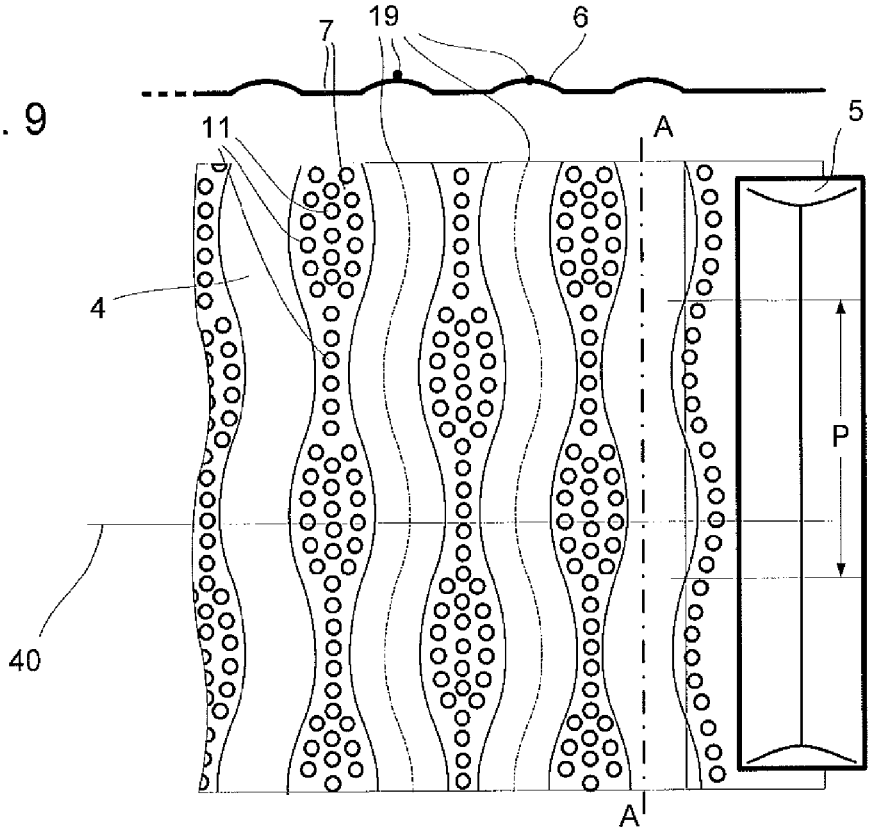
FIG. 9 shows an outer view and cross section according to FIG. 4 with wave-type elevations disposed with counter phases to one another and in a parallel manner.
Figure 11:
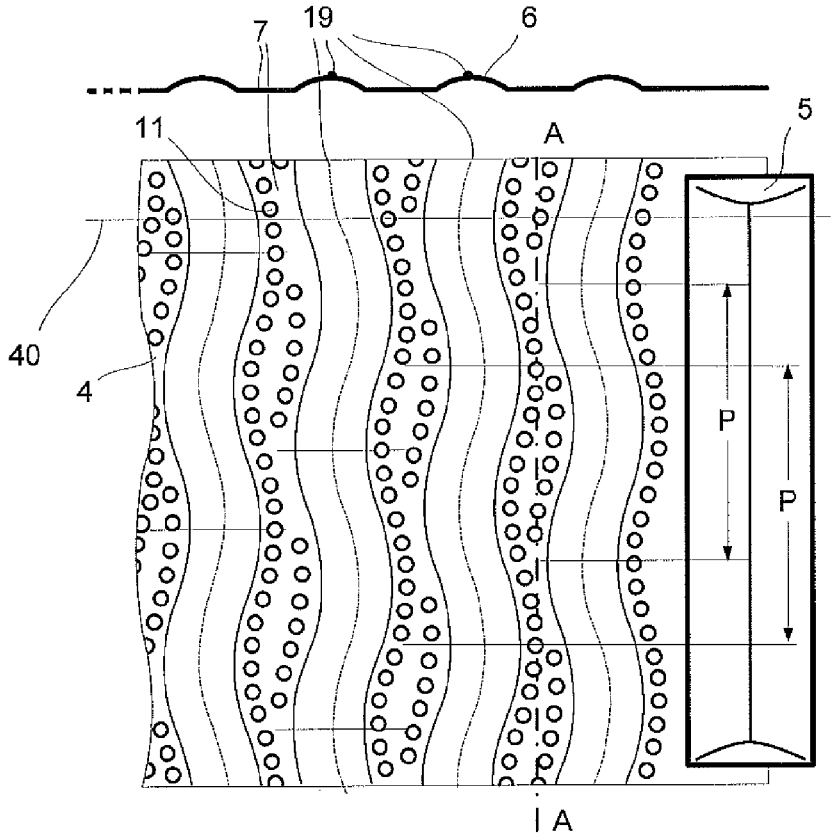
FIG. 11 shows an outer view and cross section according to FIG. 4 with wave-type elevations disposed in a parallel manner to one another but with a mutual offset.

The drum jacket 4 according to FIG. 9 also has sinusoidal linear elevations 6 like those in FIG. 4. However the phase lengths of adjacent elevations 6 alternate so that the cylindrical regions 7 in between have narrow and wide regions in the same sinusoidal line configuration, these being provided with more or fewer throughflow holes 11 per segment of the periphery. This could be decisive when selecting the variants. The phase displacement between the elevations 6 does not have to be selected as around a half phase length—as shown here. With a smaller or greater phase displacement cylindrical regions 7 result, which are also narrower and wider along the periphery. They then however also include oscillating regions, which are linear over a longer linear length and only have space for one row of throughflow holes. The wider regions in contrast are narrower than in FIG. 9. FIG. 11 shows such a variant.

Figure 10:
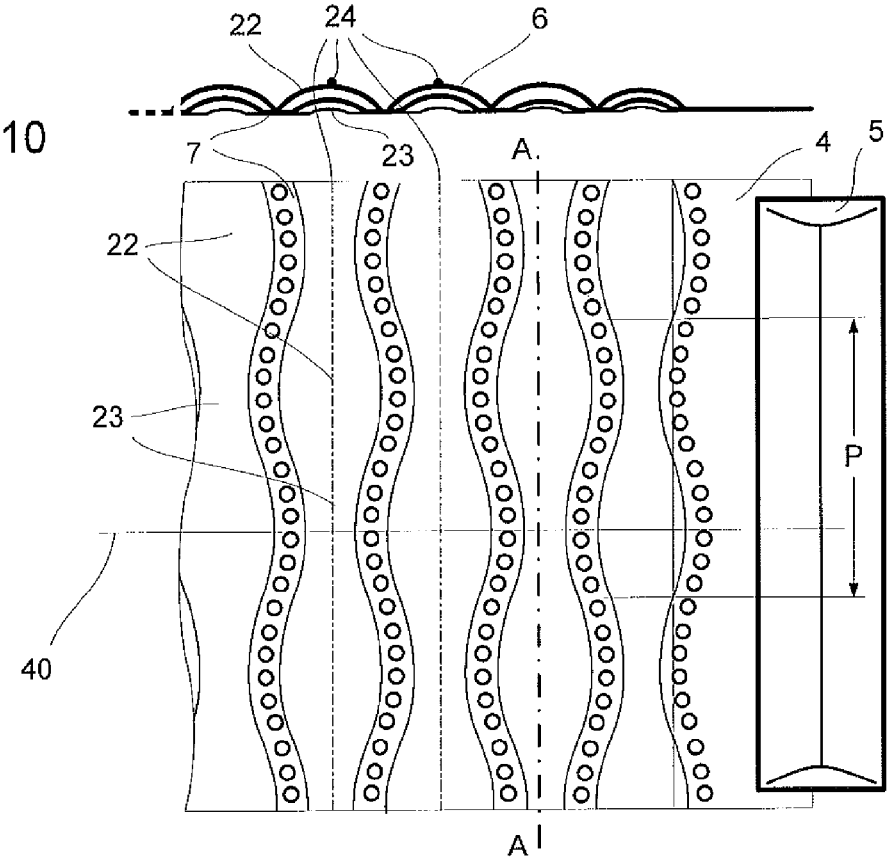
FIG. 10 shows an outer view and cross section according to FIG. 4 with elevations disposed in a parallel manner and with counter phases to one another, having varying widths in the manner of a wave.

In the exemplary embodiment in FIG. 10 the conditions are reversed compared with the example in FIG. 9. Here the cylindrical regions 7 oscillate in a counter phase manner, while the extension of the elevations 6 becomes narrower and wider parallel to the drum axis A-A. The arches 22 and 23 are correspondingly higher and lower by turn along their extension for the same curvature of the elevations 6, so that alternating high and low arches 22 and 23 result, which apply a mechanical action to the laundry in addition to the agitators 5 disposed in the drum.

Figure 12:
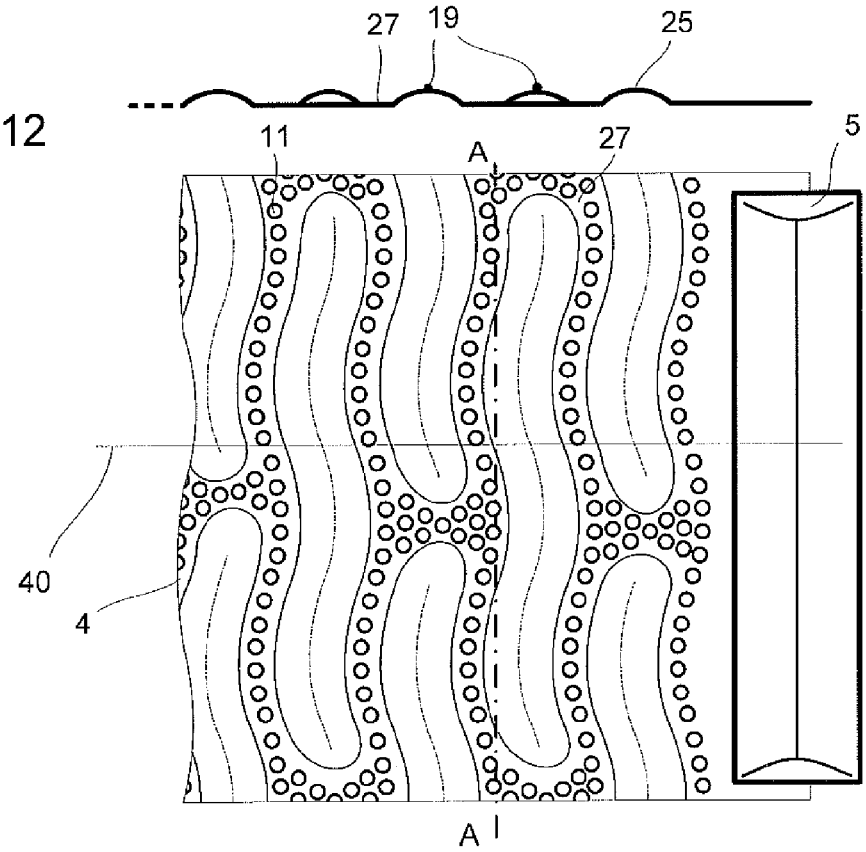
FIG. 12 shows an outer view and cross section according to FIG. 4 with wave-type elevation segments disposed parallel and with identical phases to one another, said elevation sections being respectively of limited length and offset in relation to one another.

FIG. 12 demonstrates what a drum jacket 4 can look like with finite elevations 25, so that each elevation 25 is surrounded by a cylindrical region 27. This allows the provision of a larger number of throughflow holes 11, so the fluid exchange can be intensified. The frequently changing contact of the laundry with different arches of the elevations 25 also reinforces the mechanical washing action.

Throughflow holes 11 disposed in a regular manner in the cylindrical regions 7 can also be provided in a different manner from the exemplary embodiments shown in the sides of elevations 6, 16, 18, 25, 26, 36, 46, 56 or 66 which face the fluid flowing in them when the laundry drum rotates. All the sides of the elevations 6, 16, 18, 25, 26, 36, 46, 56 and 66 shown are suitable for this, because they have at least subregions that are approximately at right angles to the moving fluid. But the parts of the elevations that at least have an angle not too far from a right angle in relation to the fluid movement, which is generally movement in the peripheral direction 40, can have throughflow holes 11 in these parts of their sides. The elevations illustrated in all the figures can also point both into the interior of the drum 4 and outward.

The invention claimed is:

1. A laundry drum for a laundry treatment machine that is rotatable about an axis, the laundry drum comprising:

a drum jacket made of a metal sheet, the drum jacket having throughflow holes and elevations distributed in a peripheral direction and extending transversely to a periphery line, and the elevations having an advantageous influence on mechanical laundry treatment during drum rotation;

wherein the elevations rise at a distance from one another and traverse the drum in a path that varies circumferentially as the elevations travel in an axial direction;

wherein agitators are disposed on an inner periphery of the drum jacket; and wherein the throughflow holes are disposed in the cylindrical regions.

2. The laundry drum of claim 1, wherein the elevations extend parallel to a direction of the axis.

3. The laundry drum of claim 1, wherein adjacent ones of the elevations are arranged at least partially at different distances from one another.

4. The laundry drum of claim 1, wherein, at least over part of the respective length of the elevations, the elevations do not extend parallel to a direction of the axial axis.

5. The laundry drum of claim 4, wherein the elevations have a substantially zigzag shape in a circumferential direction.

6. The laundry drum of claim 5, wherein an amplitude and a period of the zigzag shape are of the same order of magnitude.

7. The laundry drum of claim 5, wherein, when viewed in the peripheral direction of the laundry drum, adjacent ones of the elevations extend parallel to the direction of the axis.

8. The laundry drum of claim 5, wherein adjacent ones of the elevations extend parallel to the direction of the axis and counter to one another.

9. The laundry drum of claim 5, wherein adjacent ones of the elevations extend in the peripheral direction of the laundry drum and offset in relation to one another in the direction of the axis.

10. The laundry drum of claim 5, wherein the elevations are arranged at at least partially differing distances from one another.

11. The laundry drum of claim 4, wherein the elevations follow a wave form with an amplitude in a circumferential direction.

12. The laundry drum of claim 11, wherein the wave form has a substantially sine wave shape.

13. The laundry drum of claim 1, wherein the elevations extend helically and transversely to the peripheral direction.

14. The laundry drum of claim 1, wherein the elevations are shorter than a width of the drum jacket, and wherein adjacent ones of the elevations are offset in relation to one another in a direction of the axis.

15. The laundry drum of claim 1, wherein the elevations are at least partially of different widths as measured along their longitudinal axes.

16. The laundry drum of claim 1, wherein at least some of the throughflow holes are provided in one of one and both sides of the elevations.

17. The laundry drum of claim 1, wherein each of the elevations includes a peak that is curved as seen in a cross section of the metal sheet taken across the axes of the elevations which run parallel to a circumferential direction of the drum.

18. The laundry drum of claim 1, wherein throughflow holes are not provided in a central portion of each of the elevations nor a peak portion of each of the elevations.

19. The laundry drum of claim 18, wherein no throughflow holes are provided in the agitators.

20. The laundry drum of claim 1, wherein the elevations and the sheet metal comprise a one piece metal construction.

21. The laundry drum of claim 1, wherein the drum jacket comprises a plurality of elevations between consecutively placed agitators.

22. The laundry drum of claim 21, wherein the plurality of elevations between consecutively placed agitators comprise at least three elevations.

23. The laundry drum of claim 21, wherein the plurality of elevations between consecutively placed agitators comprise at least four elevations.

24. The laundry drum of claim 21, wherein the plurality of elevations between consecutively placed agitators comprise at least five elevations.

25. The laundry drum of claim 1, wherein the drum jacket comprises at least one said elevation disposed on at least one of the agitators.

26. The laundry drum of claim 1, wherein the height of the at least one elevation from an inner surface of the drum jacket is substantially equal to the thickness of the drum jacket.

27. The laundry drum of claim 1, wherein:

the agitators are structured to provide the primary source of mechanical laundry treatment; and the elevations are structured to provide an additional advantageous influence on mechanical laundry treatment during drum rotation.

28. A method of forming the drum of claim 1, wherein the elevations are formed by shaping the metal sheet to include inward directed curves.

* * * * *